United States Patent [19]

Iten

[11] 3,970,194

[45] July 20, 1976

[54] RAZOR BLADE CARTRIDGE AND DISPLAY ARTICLE

[75] Inventor: Clemens A. Iten, Staunton, Va.

[73] Assignee: Philip Morris Incorporated, New York, N.Y.

[22] Filed: Jan. 8, 1975

[21] Appl. No.: 539,412

[52] U.S. Cl. ..... 206/228; 30/40.2; 206/356; 206/469

[51] Int. Cl.[2] ..... B65D 83/10; A45D 27/22; B26B 21/24

[58] Field of Search ..... 206/228, 356, 469, 470, 206/471; 30/40.2, 40

[56] References Cited

UNITED STATES PATENTS

| | | | |
|---|---|---|---|
| 2,892,538 | 6/1959 | Middleton, Jr. et al. | 206/469 X |
| 3,004,661 | 10/1961 | Schumann | 206/469 |
| 3,121,493 | 2/1964 | Snape | 206/469 |
| 3,202,279 | 8/1965 | Czerkies et al. | 206/470 |
| 3,599,787 | 8/1971 | Webster, Jr. | 206/469 |
| 3,771,223 | 11/1973 | Dawidowicz et al. | 30/40 |
| 3,835,532 | 9/1974 | Petrillo | 30/40.2 |

*Primary Examiner*—Leonard Summer
*Attorney, Agent, or Firm*—Watson Leavenworth Kelton & Taggart

[57] ABSTRACT

A display article for razor blade cartridges of the type adapted to be releasably mounted on a razor handle, the article including a supporting card with a plurality of the cartridges mounted on the front of the card each under a plastic blister, the card having weakened lines defining an individual section for each of the cartridges registering with the respective cartridge adapted to be removed readily for access to the corresponding cartridge, the cartridge having means exposed at the area adapted to be engaged by the head of a razor handle and releasably secured to the handle by cooperative parts on the cartridge and head. In one form of the article the razor handle is also mounted under a blister on the card which has a removable section registering with the handle defined by weakened lines for ready removal of the handle.

6 Claims, 11 Drawing Figures

RAZOR BLADE CARTRIDGE AND DISPLAY ARTICLE

The invention concerns an article embodying means for displaying razor blade cartridges and permitting the dispensing therefrom of the individual cartridges, the latter being of the type having means which in conjunction with complemental means on the razor handle enables the handle to be engaged with the cartridge to releasably mount the cartridge on the handle the cartridges being thereby replaceable as needed in the course of use in shaving. The means for releasably securing the cartridge on the handle may vary somewhat, a common form in the prior art comprising a dovetail arrangement in which the razor head has a key slidable in a slot extending lengthwise of the cartridge at a bottom face. Dispensers for such type cartridges are also common in the prior art of a character comprising a tray with slots for the cartridges each slot having an opening at one end permitting endwise entrance of the razor head key and the cartridge then being rocked loose from lugs releasably holding it normally in its slot. An early patent, O'Reilly U.S. Pat. No. 1,195,259 discloses a razor in which the cartridge or blade holder has such a dovetail connection with the handle. More recent patents are Perry, U.S. Pat. No. 3,703,764 and Dawidowicz et al. U.S. Pat. No. 3,771,223. The latter patent and also Dawidowicz U.S. Pat. No. 3,783,493 and Petrillo U.S. Pat. No. 3,835,532 have disclosures of cartridge dispensers of the form noted above in which the cartridge may be picked up by endwise insertion of the appropriate razor head key.

In the article of the present invention the individual cartridges are mounted in the pocket of a blister affixed to a stiff card support. The use of blisters for mounting articles on a support is of course a well known expedient. Examples thereof are Rohdin U.S. Pat. No. 2,973,087, Kuster U.S. Pat. No. 3,498,448, Webster, Jr. U.S. Pat. No. 3,599,787 and Heller U.S. Pat. No. 3,685,648.

In the cartridge display and dispenser article of the present invention a series of razor blade cartridges are each independently mounted on a cardboard support underneath a blister in conjunction with other related features forming what is believed to be a new combination. The cardboard has weakened lines defining a section or area corresponding to the shape of the individual cartridge which may be removed exposing the rear face of the cartridge and enabling the razor head to be directly engaged with the respective cartridge and the cartridge lifted out by suitable movement with the assembled razor ready for use. For an initial sale of the razor combination the card may also have thereon a razor handle positioned under a blister with a suitable section of the card defined by weakened lines for exposing the handle for ready removal.

Other features and advantages will be made apparent from the description to follow of a representative example of the invention including the drawings in which.

Figure 1:
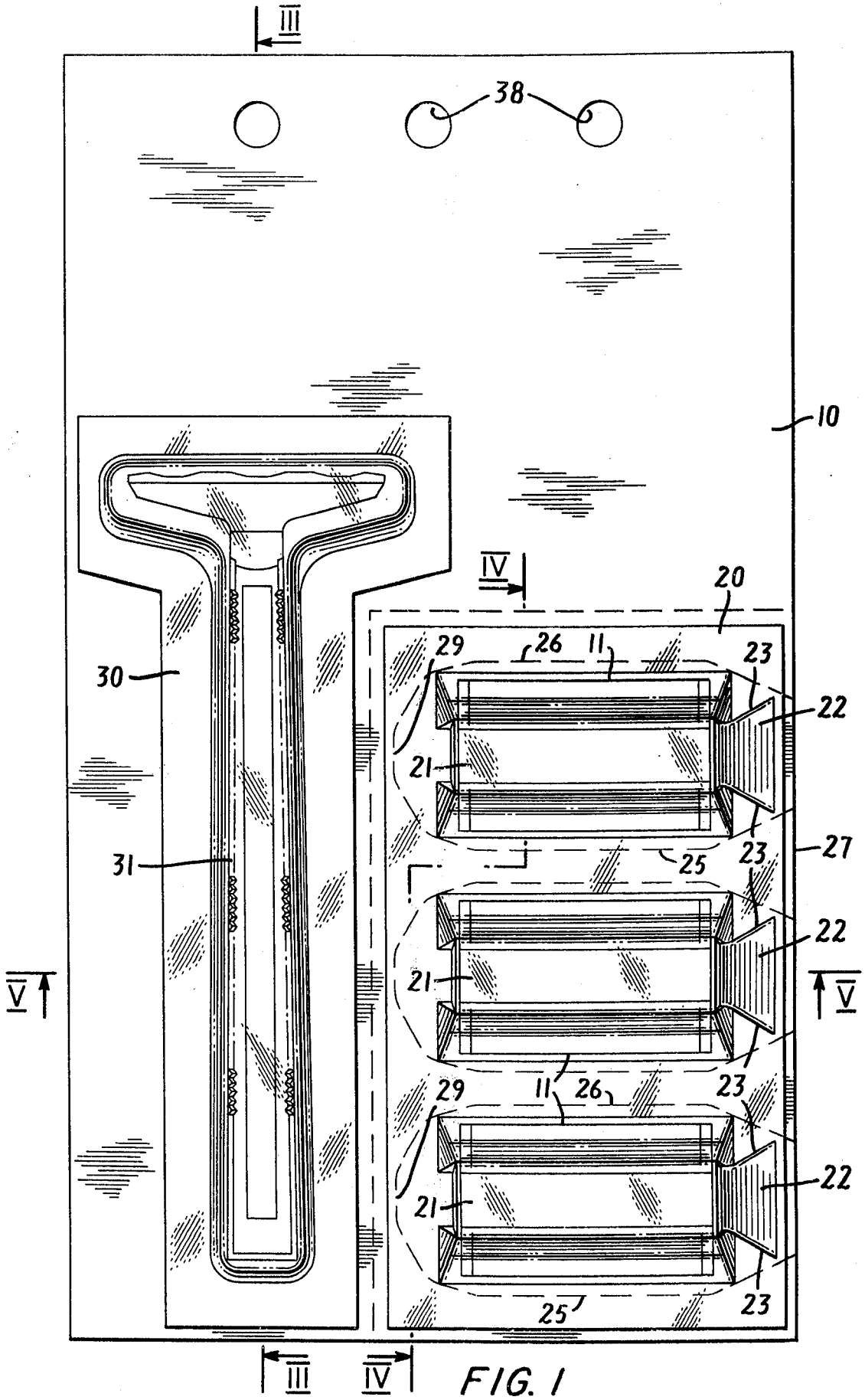
FIG. 1 is a front elevational view of one form of the assembled article including a razor handle.
Figure 2:
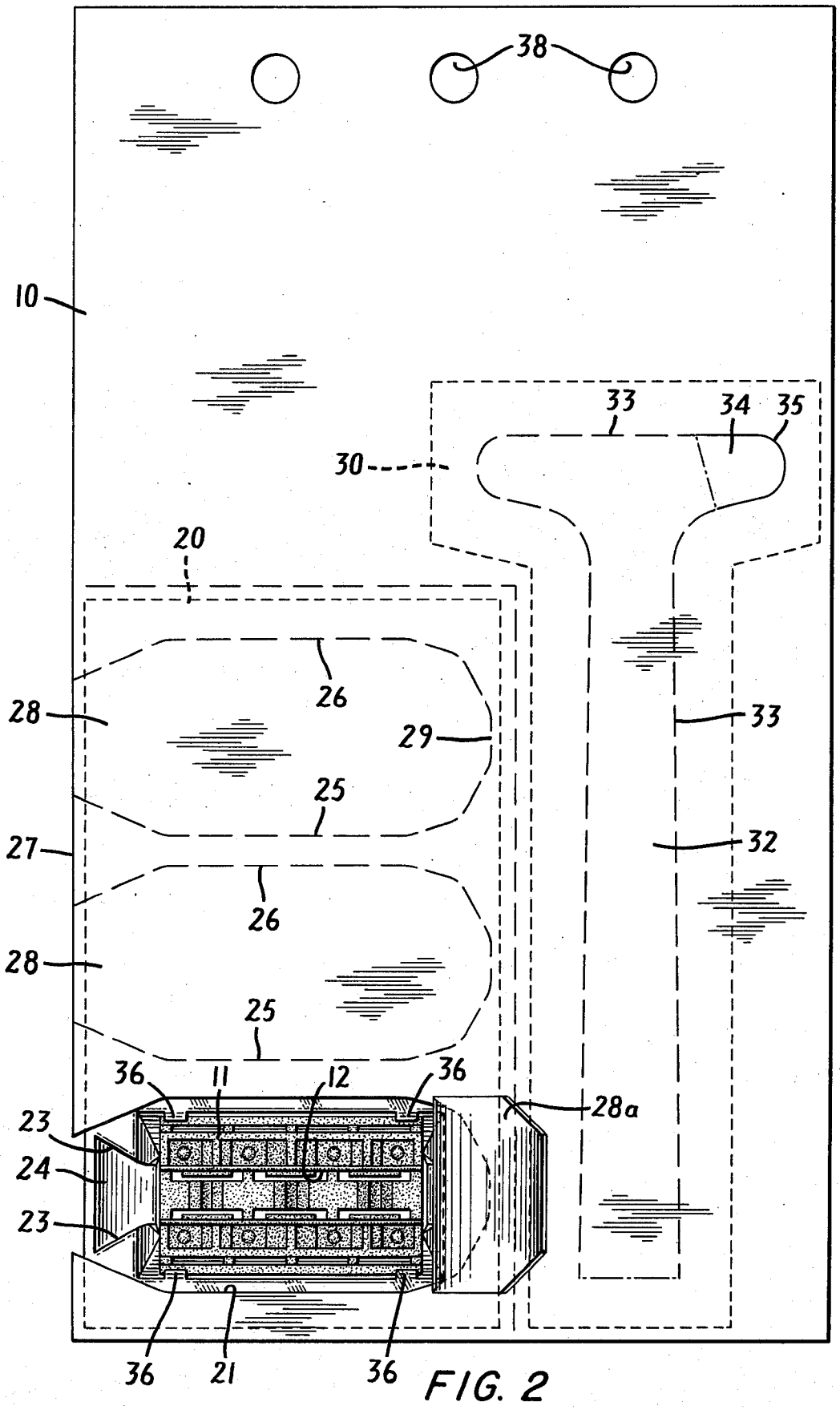
FIG. 2 is a rear elevational view thereof.
Figure 5:
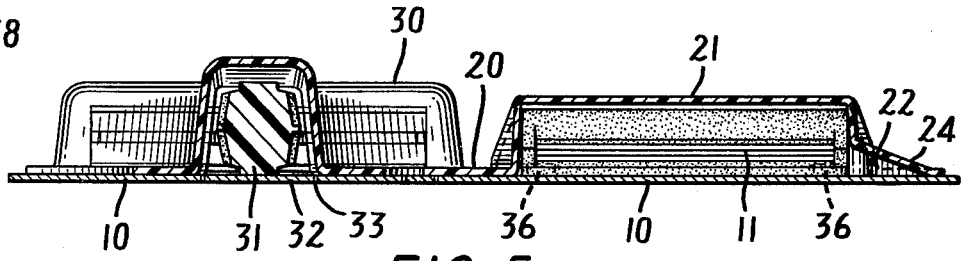
FIG. 5 is a cross sectional view taken on the plane V—V of FIG. 1.
Figure 3:
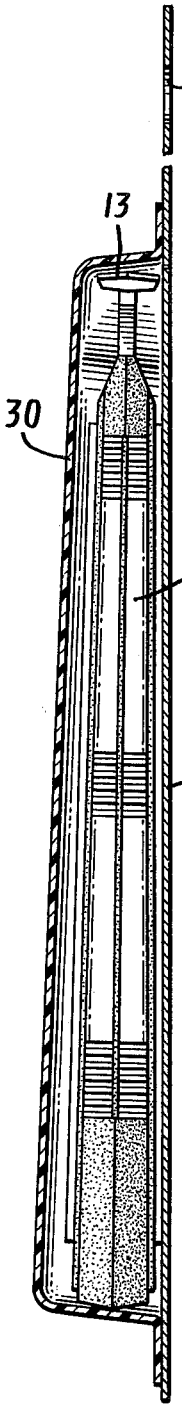
FIG. 3 is a cross sectional view taken on the plane III—III of FIG. 1.
Figure 4:
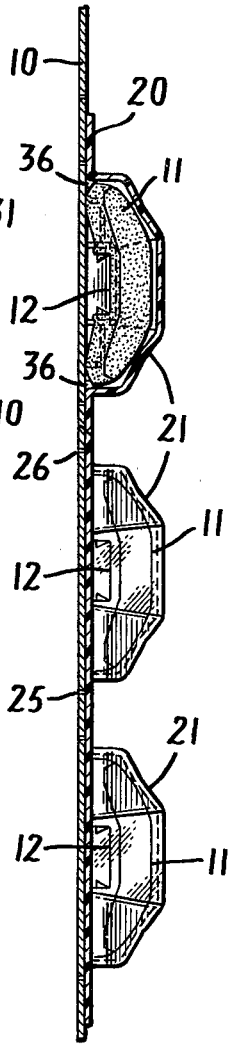
FIG. 4 is a cross sectional view taken on the plane IV—IV of FIG. 1.

The display and dispenser article pictured in FIGS. 1 to 6C comprising an exemplification of the invention includes a main supporting card 10 of suitable material such as paperboard. Mounted thereon in substantially transparent plastic blisters are a series of razor blade cartridges 11 each of which in the present case comprises a double edge blade cartridge having at the rear or bottom surface of the cartridge a slot 12 adapted in connection with a razor head key 13 (FIG. 3) to form a dovetail type of connection for mounting the cartridge on the handle and being readily replaceable by endwise movement of the key into or from the cartridge slot.

As a convenient method of manufacture of the blisters they are vacuum formed by drawing the sheet into a mold. Various types of plastic may be employed such as polyvinylchloride sheet stock having a suitable thickness normally in the range between 0.010 and 0.020 of an inch. The blisters for each cartridge may be independently formed but for convenience in the present case a plurality of blisters are formed as an integral member, such a blister being indicated at 20 in FIG. 1. In the present example three pockets 21 for three cartridges respectively are embodied in the one blister element 20 but the number and relative location can of course be varied. For ready assembling the card 10 is pre-coated on the blister side with a heat seal material.

The blister pockets 21 conform in general in shape and size to the cartridge. At an outer end each pocket has a channel 22 defined by side walls 23 diverging outwardly from the pocket 21, and a wall 24 connecting the side walls 23 inclined outwardly from the pocket 21 toward the plane of the open face of the pocket (FIG. 5), the shape serving to aid in the ready insertion of the razor head key 13. As initially formed the outer end of the wall section 24 is flat against the card whereby the pocket 21 is fully enclosed and sealed from the air. As will be pointed out hereinafter the channels 22 extend substantially to the outer edge of the card. As indicated particularly in FIG. 2 the card 10 has weakened lines 25 and 26 provided by perforations which extend to the edge 27 of the card defining sections or areas 28 which may be readily torn off for access to the cartridge within the corresponding pocket. The lines defining the pocket may include a non-perforated region 29 defining an area at which the tab section 28 may be left hanging if desired.

For an initial sale for example the article may also be made to hold the razor handle and for that purpose a blister 30 encloses the handle 31, the blister being vacuum formed similarly to the blister for the cartridges. The card has a removable section 32 corresponding in shape to the razor handle defined by the line of perforations 33. The section includes a tab portion 34 defined by a cut line 35 which may be grasped as an initial step in removing the section 32.

Each cartridge pocket 21 is provided with suitable means for releasably holding the cartridge in the pocket when the section 27 is removed. In the present case these comprise small lugs 36 at each side of the open face of the pocket extending slightly over the rear face of the cartridge. Being formed of plastic integrally with the blisters the lugs are flexible. The card is adapted to be hung vertically if desired particularly for display and for that purpose is provided with an extension having therein holes 38 for engagement over nails or other type of pins.

Figure 7:
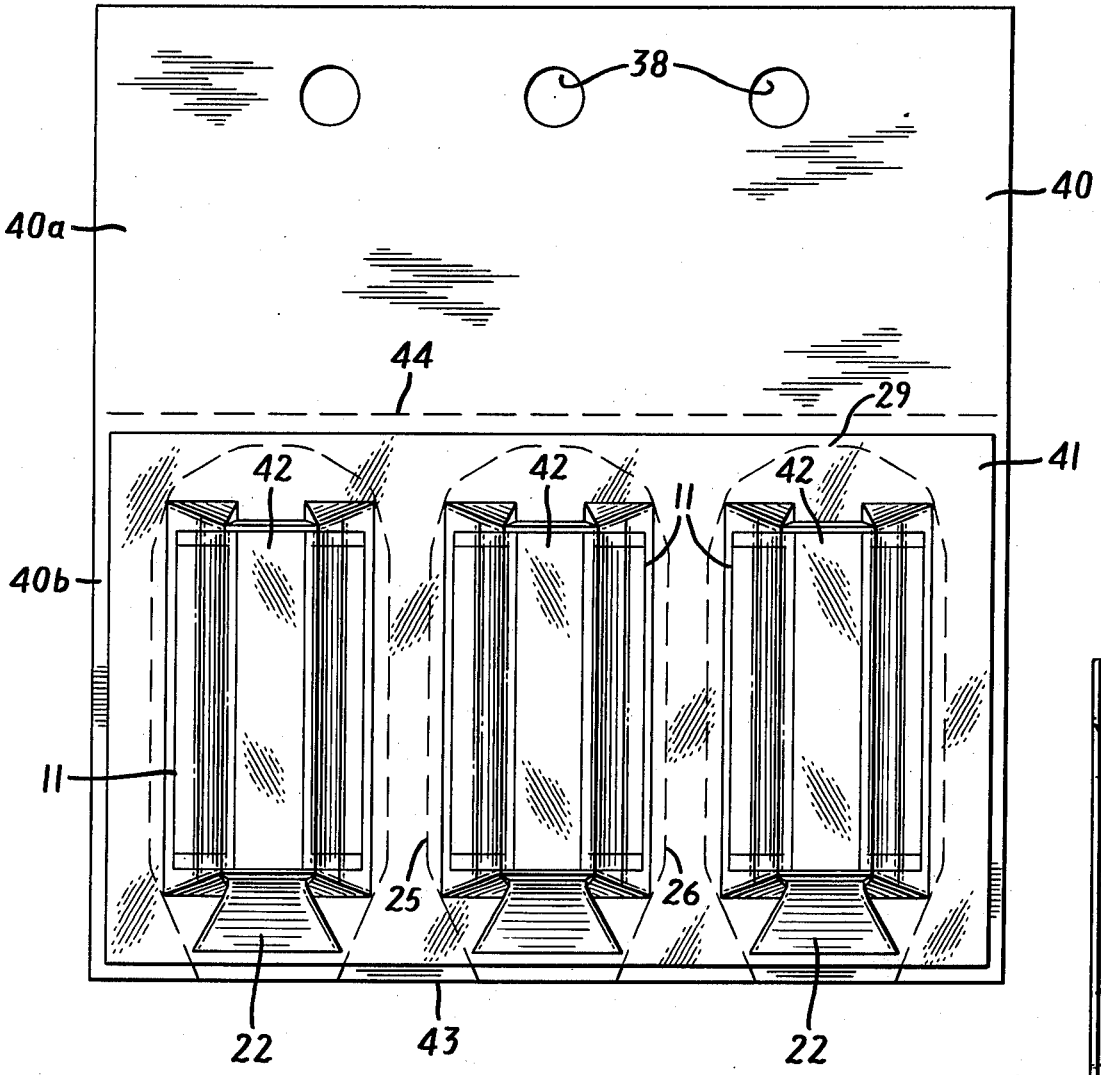
FIG. 7 is a plan view of a form of the article omitting the razor handle and adapted to supply replacement cartridges.
Figure 9:
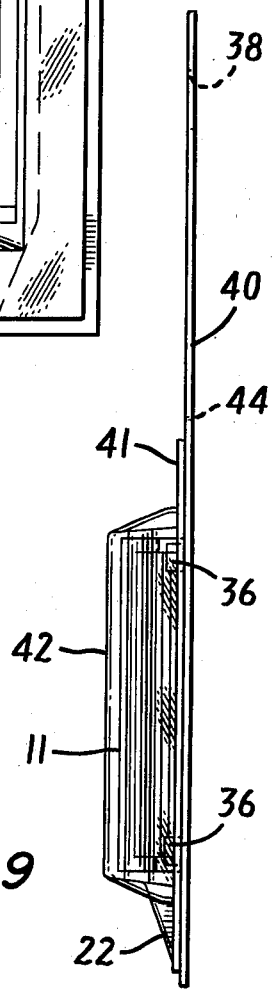
FIG. 9 is an edge view of the article of FIG. 7.
Figure 8:
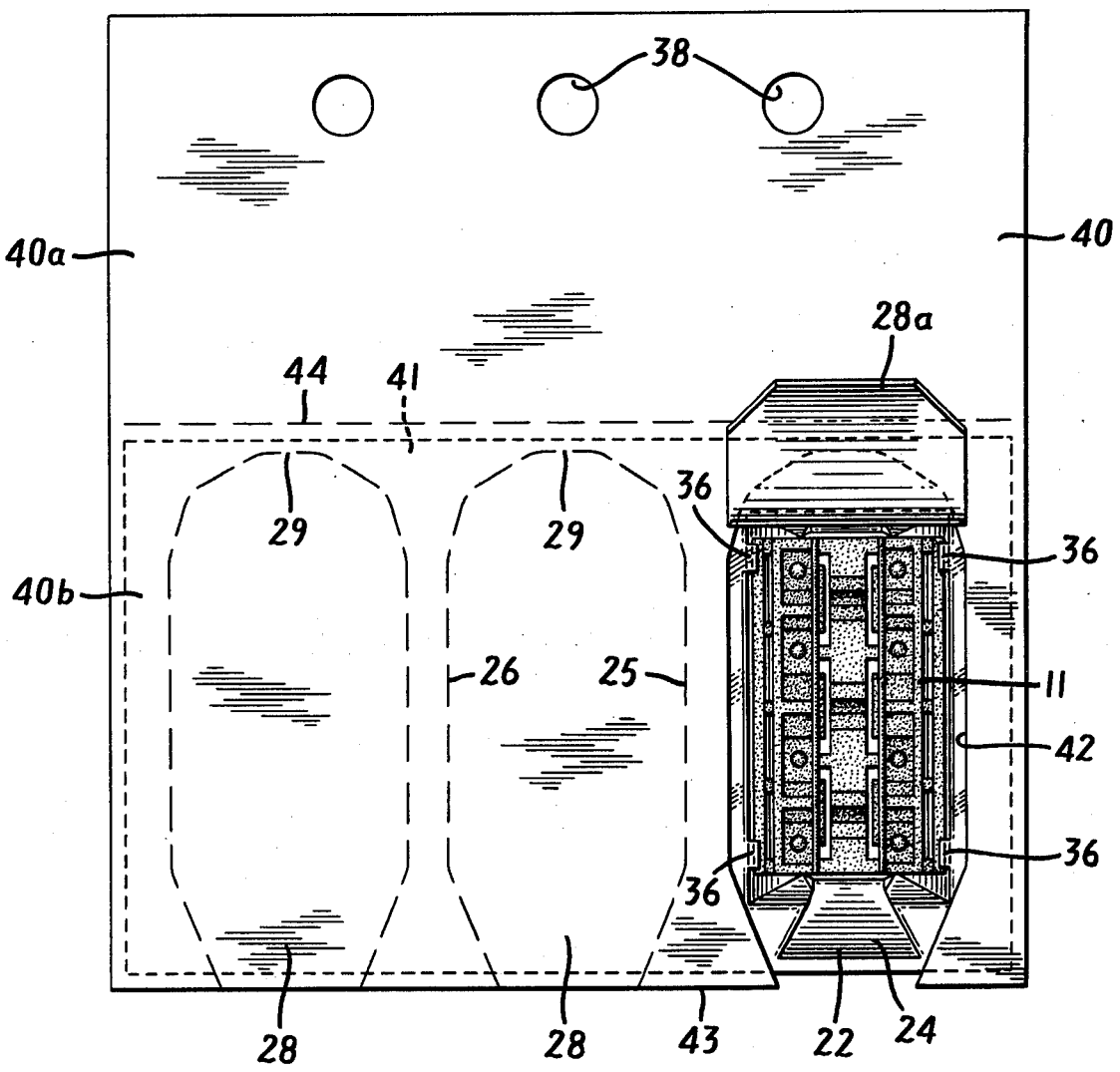
FIG. 8 is a rear view of the article of FIG. 7.

The invention may be embodied in various forms. In particular cards may be provided containing only cartridges to be used as replacements. FIGS. 7 to 9 show one such type of article. It embodies a supporting card 40 provided with a blister 41 having three pockets 42 with cartridges 11. In this case the pockets 42 extend outwardly to the bottom edge 43 of the card. Preferably the card has a line 44 weakened as by perforations whereby the upper section of the card 40*a* may be torn off leaving the reduced small section 40*b* with the blister for convenient inclusion in a toilet kit for example. In other details the card and contents are similar to the corresponding part of the article of FIGS. 1 to 6*c*. Cards with replacement cartridges may have various shapes and arrangements and number of cartridges.

In assembling, the cartridges are first inserted in the respective blisters with the cartridge channels 12 arranged outwardly. The cartridges are readily snapped into position past the flexible lugs 36. The charged blister or blisters, as the case may be, are then applied to the heat seal coated surface of the card and heat applied to secure the blisters in place. The blisters have ample marginal areas extending outwardly from the pockets to securely hold the blisters in place. The razor where the article embodies one is similarly inserted in its blister and secured to the card.

Figure 6A:
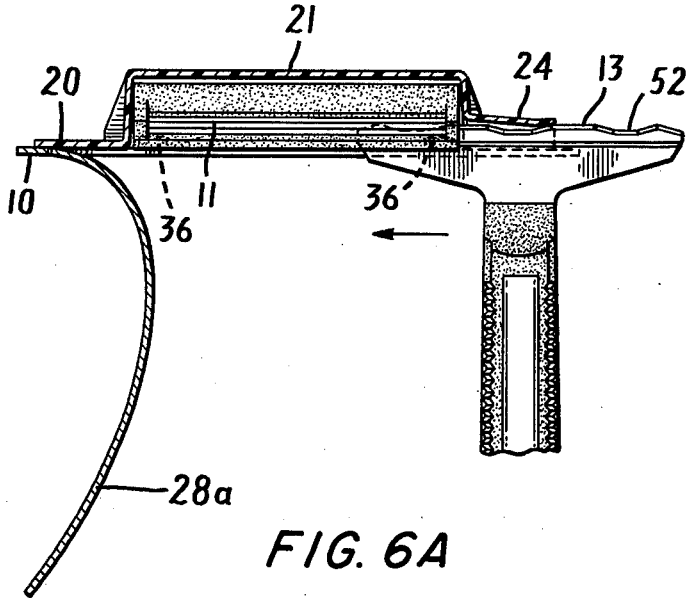
FIGS. 6A, 6B and 6C are fragmentary cross sectional views illustrating the manner of picking up a cartridge and mounting it on a razor head.

FIGS. 6A, B and C illustrate the operation of assembling a cartridge on the razor head. The outer end of the perforation defined section 28 is grasped and the section completely torn from the card or, if desired, merely pulled to some position such as shown at 28*a* in FIG. 6A. As previously noted the perforations 25 and 26 terminate at their inner ends without meeting, leaving a non-perforated section 29 whereby the section 28 may be left connected to the card as indicated in 6A. In accordance with such optional variations in the card, when reference is made to removal of the section such term is intended to mean removal from the opening to the cartridge pocket 21 and not necessarily complete separation from the card.

Figure 6B:
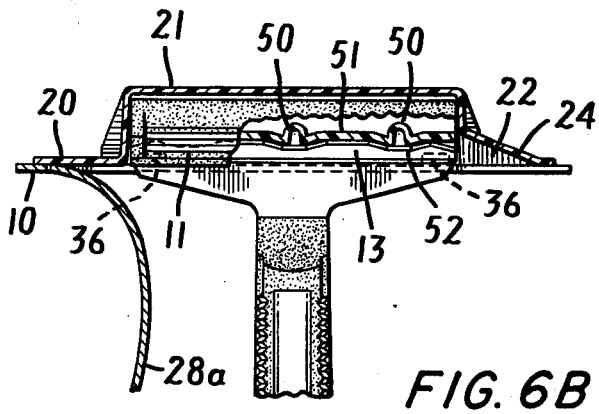
Figure 6C:
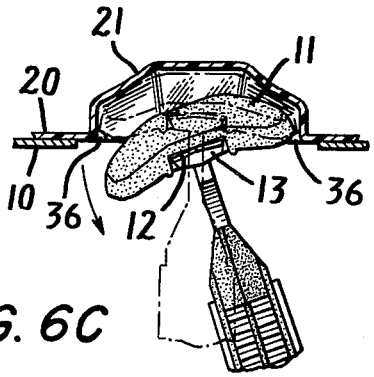

Following removal of the section 28 to the attached position shown in FIG. 6A or completely from the card, the razor head 13 is slid endwise into the cartridge channel 22 and continued on to the full insertion position shown in FIG. 6B. The flexibility of the plastic sheet material permits the wall section 24 to be deflected to the position shown in FIG. 6A under pressure from the razor head 13 and the head to be moved straight in parallel to the cartridge slot 12. Detent or latch means are provided for appropriately positioning the razor key 13 in the slot 12. In the present case this comprises detents 50 mounted on the flexible bar 51, the detents being adapted to engage in notches 52 in the top surface of the razor key 13. When the razor key 13 has reached its home position as indicated in FIG. 6B the cartridge may be readily removed from the pocket 21 by a rocking action or pulling directly outwardly on the handle or a combination of such movements, the lugs 36 of plastic material readily permitting such action. FIG. 6C illustrates a rocking action about an axis parallel to the razor head 13, but the rocking could be in an arc 90° thereto, or as stated, a combination of such action.

Used cartridges may be readily inserted into a pocket by an operation which is substantially the reverse of that shown in FIG. 6A, B and C. In other words, the cartridge attached to the handle is pressed into the pocket 21 and the key 13 then slid to the right from a position such as shown in FIG. 6B leaving the used cartridge in the pocket.

It has been pointed out that various changes may be made in the structural details and relations of the parts shown and described herein and further variations and embodiments of the invention may be made within the principles thereof and accordingly it is intended that all matter contained herein shall be interpreted as illustrative and not in a limiting sense.

What is claimed is:

1. A display and dispenser article for razor blade cartridges of a type having at its rear face a dovetail slot for the endwise reception therein of a complemental razor handle key, said article comprising a main card, a blister secured to the front of the card having a pocket with an open rear face shaped to receive and having therein a said cartridge with its rear face with the dovetail slot at the rear, said blister having an outwardly extending channel portion registering with an end of said cartridge dovetail slot and having side walls diverging outwardly to a width larger than the end of the cartridge dovetail slot and a connecting wall between said side walls to guide readily the razor handle key into the slot, and said card having a section defined by weakened lines registering substantially with the open rear face of said pocket whereby removal of said section permits ready insertion of the handle key into engagement with and removal of the cartridge.

2. An article in accordance with claim 1 in which said connecting wall is inclined outwardly from said pocket toward said card.

3. An article in accordance with claim 2 in which the outer end of said channel portion connecting wall is engaged against said card.

4. An article in accordance with claim 3 in which said blister is formed of flexible sheet material enabling the channel portion including said connecting wall to permit the ready insertion of the handle key.

5. An article in accordance with claim 1 in which said channel portion extends to substantially an edge of the card.

6. A display article for a razor and razor blade cartridges comprising a main card, a blister secured to the front of the card having a pocket with an open rear face shaped to receive and having therein a razor handle with a part adapted to engage a cartridge thereon, the card having weakened lines and a free tab portion defining a section registering subtantially with the open rear face of the razor pocket to permit removal of said section and thereby of the razor handle, a second single blister secured to the front of the card, said single blister having a series of pockets each with a cartridge therein, each cartridge arranged with an end adjacent the edge of the card, and each pocket having a channel extending to the end of the card shaped and arranged to guide said razor handle part into engagement with the respective cartridge, said card having weakened lines defining an individual section for each of the cartridge pockets registering substantially with the open rear face of the corresponding pocket to permit removal of the section and thereby engagement of the razor handle part for removal of its cartridge.

* * * * *